United States Patent [19]

Tanaka et al.

[11] Patent Number: 4,507,934

[45] Date of Patent: Apr. 2, 1985

[54] REFRIGERATING SYSTEMS HAVING DIFFERENTIAL VALVE TO CONTROL CONDENSER OUTFLOW

[75] Inventors: Tatsuo Tanaka, Fuji; Toshiaki Kawamura, Shimizu, both of Japan

[73] Assignee: Tokyo Shibaura Denki Kabushiki Kaisha, Kawasaki, Japan

[21] Appl. No.: 493,766

[22] Filed: May 11, 1983

[30] Foreign Application Priority Data

May 26, 1982 [JP] Japan ..... 57-89267

[51] Int. Cl.[3] ..... F25B 41/04

[52] U.S. Cl. ..... 62/210; 62/222; 62/DIG. 17

[58] Field of Search ..... 62/511, 222, 205, 204, 62/210, 208, 209, DIG. 17, 196.4, 206

[56] References Cited

U.S. PATENT DOCUMENTS 1,880,653 10/1932 Baars ..... 62/205

2,265,282 12/1941 Heinrich ..... 62/222 X 2,331,264 10/1943 Carter ..... 62/511 X 3,037,362 6/1962 Tilney et al. ..... 62/222 X

*Primary Examiner*—Harry Tanner

*Attorney, Agent, or Firm*—Schwartz, Jeffery, Schwaab, Mack, Blumenthal & Koch

[57] ABSTRACT

In a refrigerating system comprising a compressor, a condenser, a capillary tube, and an evaporator, there are provided a check valve on an inlet side of the condenser for preventing a reverse flow of refrigerant from the condenser to the compressor, and a differential valve connected to a delivery side of the condenser. One port of the differential valve is connected with the delivery side of the compressor, so that the differential valve interrupts the flow of the refrigerant from the condenser to the capillary tube upon interruption of the operation of the compressor thereby to improve the operational efficiency of the refrigerating system when the system is started again.

5 Claims, 5 Drawing Figures

REFRIGERATING SYSTEMS HAVING DIFFERENTIAL VALVE TO CONTROL CONDENSER OUTFLOW

BACKGROUND OF THE INVENTION

This invention relates to a refrigerating system, and more particularly to an improved construction of a refrigerating system wherein a differential valve operable under a pressure difference between the delivery side of the compressor and the condenser is provided for preventing the reduction in the operating efficiency of the refrigerating system caused at the time of starting the system.

In a case where the operation of a refrigerator comprising a compressor, condenser, evaporator and a capillary tube is once interrupted, the refrigerant in the condenser tends to flow out of the condenser, thus reducing the condenser pressure temporarily and deteriorating the operational efficiency of the refrigerator at the starting time thereof. Furthermore, a comparatively high temperature of the refrigerant thus flowing out of the condenser inevitably raises the temperature of the evaporator, thus activating a thermostat and restarting the compressor prematurely.

Various constructions of the refrigerating system (or cycle) have been proposed for preventing the pressure reduction in the condenser, and thereby improving the operational efficiency of the refrigerating system (or cycle) at the starting time.

For instance, in a conventional construction shown in FIG. 1, an electromagnetic valve 2 and a check valve 4 are provided on the delivery side and the inlet side of the condenser 1, respectively. When the operation of the compressor 3 is interrupted, the electromagnetic valve 2 is closed to stop delivery of the refrigerant from the condenser 1, while the check valve 4 is operated to prevent the refrigerant in the condenser 1 from flowing back into the compressor 3.

In the above described construction of the refrigerating system, however, a considerable amount of electric power is consumed in the electromagnetic valve 2, and therefore the operational efficiency of the refrigerating system could not be improved remarkably.

SUMMARY OF THE INVENTION

An object of the present invention is to provide a refrigerating system wherein all of the above described shortcomings of the conventional construction can be substantially eliminated, and the operational efficiency at the time of resuming the operation of the system can be substantially improved.

Another object of the invention is to provide a refrigerating system wherein the construction of the refrigerating system can be much simplified, and the operational efficiency at the time of resuming the operation of the system can be substantially improved.

According to the present invention, there is provided a refrigerating system comprising a compressor, a condenser, a capillary tube, and an evaporator which are connected in series for circulating a refrigerant therethrough, the refrigerating system further comprising: a check valve provided on an inlet side of the condenser for preventing a reverse flow of the refrigerant from the condenser to the compressor, and a differential valve having a first port connected with a delivery side of the condenser, a second port connected with an inlet side of the capillary tube, a third port connected with a delivery side of the compressor, and means for interrupting flow of the refrigerant from the first port to the second port when a pressure of the refrigerant at the first port is lower than that of the refrigerant at the third port.

The invention will now be described in detail with reference made to the accompanying drawings.

DESCRIPTION OF THE PREFERRED EMBODIMENT

Figure 1:
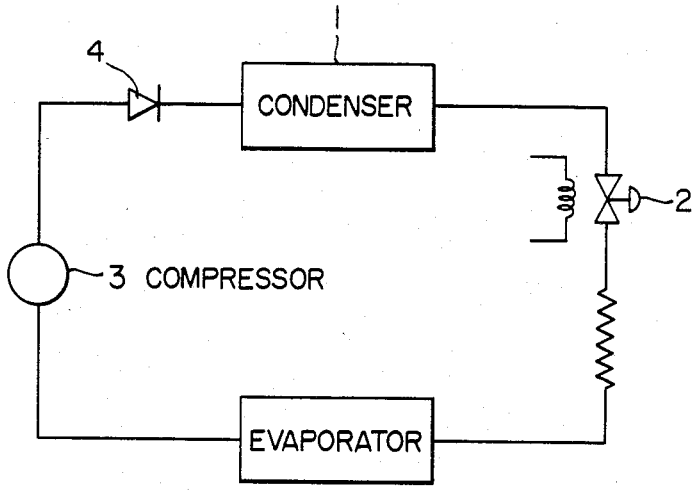
PRIOR ART FIG. 1
FIG. 1 is a diagram showing a conventional refrigerating system.
Figure 2:
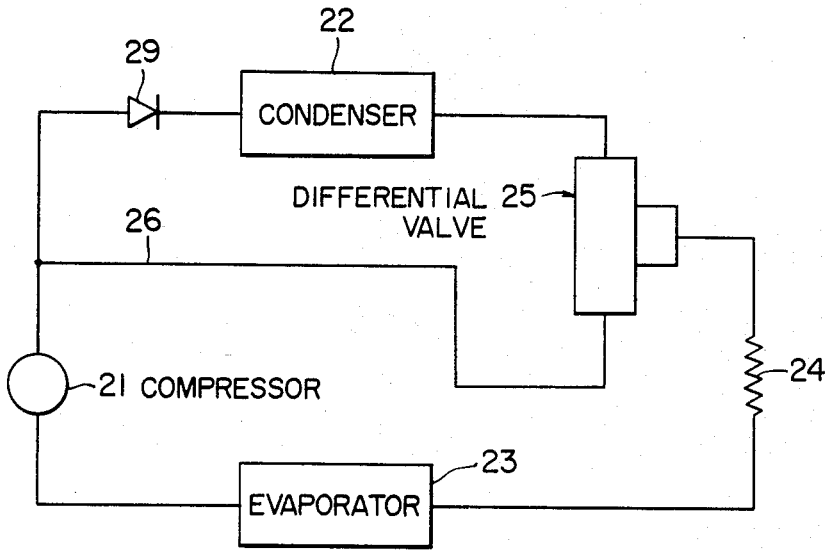
FIG. 2 is a diagram showing a refrigerating system constituting an embodiment of the present invention.

A preferred embodiment of the present invention is shown in FIG. 2. In this embodiment also a condenser 22 and an evaporator 23 are provided on the delivery side and the suction side of a compressor 21, respectively, and a capillary tube 24 is provided between the condenser 22 and the evaporator 23.

According to the invention, a differential valve 25 is further provided between the delivery side of the condenser 22 and the capillary tube 24, with an inlet port thereof connected with the delivery side of the compressor 21 through a pressure transmitting conduit 26.

Figure 3A:
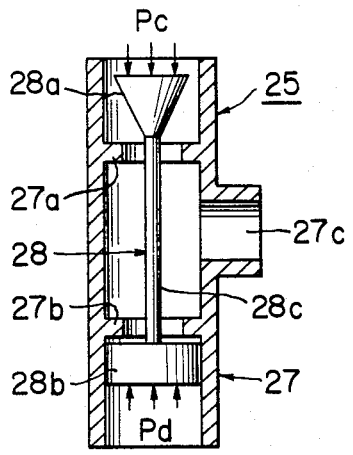
FIGS. 3(*a*) and 3(*b*) are longitudinal sectional views showing different operating states of a differential valve used in the embodiment shown in FIG. 2.
Figure 3B:
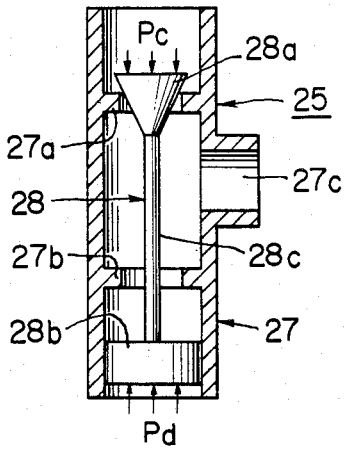

As shown in FIGS. 3(*a*) and 3(*b*), the differential valve 25 has a cylindrical body 27 in which a valve seat 27*a* and a stop 27*b* are formed. A port provided at the top of the cylindrical body 27 is connected with the delivery side of the condenser 22, while another port provided at the lower end of the body 27 is connected through the conduit 26 to the delivery side of the compressor 21.

Between the valve seat 27*a* and the stop 27*b* of the valve body 27, there is provided a central port 27*c* which is connected with an inlet side of the capillary tube 24. As a consequence, the delivery side of the condenser 22 is communicated with the capillary tube 24 through the valve seat 27*a*.

Within the valve body 27, there is provided a stem member 28 reciprocatable in the longitudinal direction of the valve body 27. The stem member 28 has at an end thereof a valve portion 28*a* engageable with the valve seat 27*a* so as to close the passage between the condenser 22 and the capillary tube 24, and at the other end thereof a slider portion 28*b* formed into a cylindrical configuration, which is slidable in a fluid-tight manner within a lower part of the valve body 27 toward or away from the stop 27*b*. The valve portion 28*a* and the slider portion 28*b* of the stem member 28 are acted upon the delivery side pressure of the condenser 22 and the delivery side pressure of the compressor 21, respectively, and depending on the difference between the two pressures, the stem member 28 is shifted in either one of the two directions, in which the valve portion 28*a* is brought into engagement with or disengagement out of the valve seat 27*a*.

A check valve 29 is provided on the inlet side of the condenser 22 for preventing the reverse flow of the refrigerant from the condenser 22 to the compressor 21 when the operation of the compressor 21 is interrupted. The pressure transmitting conduit 26 extends from the delivery side of the compressor 21 to the lower port of the differential valve 25, provided in communication with the lower part of the valve body 27 in which the slider portion **28*b* of the stem member 28** is contained.

Figure 4:
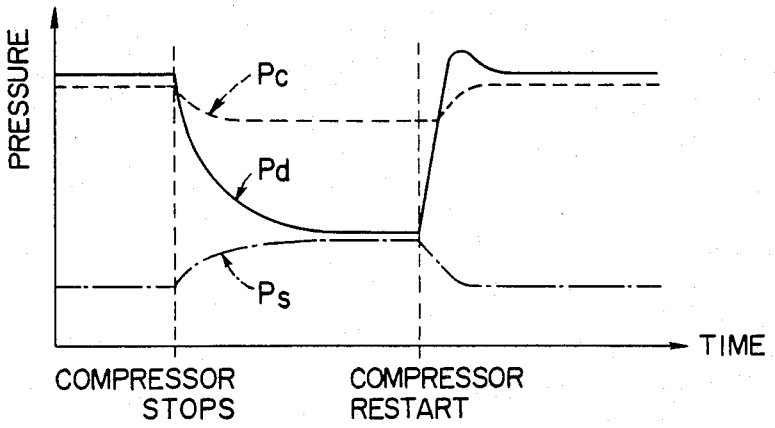
FIG. 4 is a graphical representation of pressures at various parts of the refrigerating system according to the present invention when the operation of a compressor of the system is stopped and then started again.

FIG. 4 represents pressure variations of various parts of the refrigerating system of the above described construction when the compressor 21 is once stopped and then started again depending on the load condition. In FIG. 4, Pc, Pd and Ps designate the delivery side pressure of the condenser 22, the delivery side pressure of the compressor 21, and the suction side pressure of the compressor 21, respectively.

When the compressor 21 is operated continuously, the delivery side pressure Pd thereof is slightly larger than the delivery side pressure Pc of the condenser 22, and therefore the force acting on the slider **28*b* of the differential valve 25 exceeds the force acting on the valve portion 28*a* of the stem member 28. Thus the stem member 28 is shifted upwardly as shown in FIG. 3**(*a*) disengaging the valve portion **28*a* from the valve seat 27*a*, and thereby passing the refrigerant from the condenser 22 to the evaporator 23 through the capillary tube 24**.

When the operation of the compressor 21 is interrupted, the delivery side pressure Pd of the compressor 21 is reduced rapidly, while the delivery side pressure Pc is reduced gradually, thus establishing a condition Pc>Pd immediately after the interruption of the compressor 21. As a consequence, the stem member 28 is shifted downwardly as shown in FIG. 3(*b*), thus causing the valve portion **28*a* to engage with the valve seat 27*a*, and thereby interrupting the flow of the refrigerant from the condenser 22 to the evaporator 23 through the capillary tube 24. Furthermore, the check valve 29 provided on the inlet side of the condenser 22 prevents the pressurized refrigerant in the condenser 22 from flowing reversely into the compressor 21**.

Since the differential valve 25 closes as described above, and the check valve 29 prevents the reverse flow of the refrigerant as mentioned before, the reduction of the pressure Pc on the delivery side of the condenser 22 at the time of the interruption of the compressor 21 is minimized, and the pressure Pc is substantially maintained at a constant value as shown in FIG. 4.

When the operation of the compressor 21 is started again, the pressure Pd on the delivery side of the compressor 21 goes up abruptly, and in an example of the present invention, the pressure Pd exceeds the pressure Pc in about 2 seconds. Thus, the differential valve 25 is opened, and the refrigerant in the condenser 22 flows through the valve 25 to the capillary tube 24 and the evaporator 23.

Since the reduction of the pressure Pc on the delivery side of the condenser 22 at the time of the interruption of the compressor 21 has been minimized as described above, the pressure Pc returns to its normal value in an extremely short period after the resumption of the operation of the compressor 21, and the energy required for recovering the normal value of the pressure Pc is extremely low.

Furthermore, since the delivery side pressure Pd of the compressor 21 at the time of the interruption of the compressor 21 can be lowered as described hereinbefore, the difference at that time between the pressures Pc and Pd is increased and positive operation of the differential valve 25 can be thereby assured.

We claim:

1. A refrigerating system comprising a compressor, a condenser, a capillary tube, and an evaporator, which are connected in series for circulating a refrigerant therethrough, said refrigerating system further comprising:

a check valve provided on an inlet side of said condenser for preventing a reverse flow of the refrigerant from said condenser to said compressor; and a differential valve having a first port connected with a delivery side of the condenser, a second port connected with an inlet side of said capillary tube, a third port connected with a delivery side of said compressor, and means for interrupting flow of the refrigerant from said first port to said second port when a pressure of the refrigerant at the first port is higher than that of the refrigerant at the third port.

2. A refrigerating system as set forth in claim 1 wherein said means comprises a stem member movable in a valve body of said differential valve having said ports, a valve portion provided at one end of said stem member so as to be engageable with a valve seat provided integral with said valve body, a slider portion provided at the other end of said stem member for receiving the pressure of the refrigerant at the third port, and a stop member provided in said valve body for limiting the movement of said stem member.

3. A refrigerating system as set forth in claim 2 wherein said stem member is moved by a difference of pressures applied to said slider portion and said valve portion of said stem member through said third port and said first port, respectively.

4. A refrigerating system as set forth in claim 2 wherein said valve portion of said stem member is formed into a conical shape, and the pressure of the refrigerant at the first port is applied to the base portion of the conical shape.

5. A refrigerating system as set forth in claim 2 wherein said slider portion of said stem member is formed into a cylindrical shape slidable in a cylindrical wall that is provided in said valve body for guiding the movement of said stem member.

* * * * *